US010662913B2

(12) United States Patent
Etlender et al.

(10) Patent No.: US 10,662,913 B2
(45) Date of Patent: May 26, 2020

(54) INJECTOR

(71) Applicant: Continental Automotive GmbH, Hannover (DE)

(72) Inventors: Roman Etlender, Regensburg (DE); Willibald Schuerz, Pielenhofen (DE); Werner Reim, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 634 days.

(21) Appl. No.: 14/442,471

(22) PCT Filed: Nov. 7, 2013

(86) PCT No.: PCT/EP2013/073297
§ 371 (c)(1),
(2) Date: Jul. 25, 2016

(87) PCT Pub. No.: WO2014/075988
PCT Pub. Date: May 22, 2014

(65) Prior Publication Data

US 2016/0319785 A1 Nov. 3, 2016

(30) Foreign Application Priority Data

Nov. 13, 2012 (DE) ..... 10 2012 220 610

(51) Int. Cl.
*F02M 51/06* (2006.01)
*F02M 61/16* (2006.01)
(Continued)

(52) U.S. Cl.
CPC ..... *F02M 51/0603* (2013.01); *F02M 47/02* (2013.01); *F02M 61/10* (2013.01);
(Continued)

(58) Field of Classification Search
CPC .... F02M 47/02; F02M 51/0603; F02M 61/10; F02M 61/18; F02M 61/167;
(Continued)

(56) References Cited

U.S. PATENT DOCUMENTS 5,803,429 A 9/1998 Tsuzuki et al. ..... 251/30.04
6,367,453 B1 4/2002 Igashira et al. ..... 123/467
(Continued)

FOREIGN PATENT DOCUMENTS

CN 101395366 A 3/2009 ..... F02M 47/02
CN 102691605 A 9/2012 ..... F02M 47/02
(Continued)

OTHER PUBLICATIONS

Chinese Office Action, Application No. 201380059352.8, 13 pages, dated Oct. 21, 2016.
(Continued)

*Primary Examiner* — Jason J Boeckmann
(74) *Attorney, Agent, or Firm* — Slayden Grubrt Beard PLLC

(57) ABSTRACT

The teachings of the present disclosure describe an injector having an injector housing, an actuator, and a nozzle needle, wherein the actuator is arranged in an actuator space of the injector housing. The injector may include a control piston bore in the injector housing, in which a control piston is arranged, a leakage pin bore between the actuator space and the control piston bore, and a leakage pin coupling the control piston to the actuator, the leakage pin arranged in the leakage pin bore. The control piston may be hydraulically connected to the nozzle needle in order to open or close an outlet opening of the injector housing. The injector may include a high pressure line configured to convey a fuel
(Continued)

under pressure to the nozzle needle and a feedline in the injector housing connecting the leakage pin bore to the high pressure line.

10 Claims, 3 Drawing Sheets

(51) Int. Cl.

| | |
|---|---|
| ***F02M 61/18*** | (2006.01) |
| ***F02M 47/02*** | (2006.01) |
| ***F02M 61/10*** | (2006.01) |
| ***F02M 63/00*** | (2006.01) |

(52) U.S. Cl.
CPC ..... *F02M 61/167* (2013.01); *F02M 61/18* (2013.01); *F02M 63/0026* (2013.01); *F02M 2200/21* (2013.01); *F02M 2200/28* (2013.01); *F02M 2200/701* (2013.01); *F02M 2200/704* (2013.01); *F02M 2547/001* (2013.01)

(58) Field of Classification Search
CPC ..... F02M 2200/001; F02M 2200/0026; F02M 2200/21; F02M 2200/28; F02M 2200/701; F02M 2200/703; F02M 2200/704
See application file for complete search history.

(56) References Cited

U.S. PATENT DOCUMENTS

| | | | | |
|---|---|---|---|---|
| 8,245,955 | B2 | 8/2012 | Yurtseven | 239/533.11 |
| 8,448,878 | B2 * | 5/2013 | Ibrahim | F02M 63/0043 239/5 |
| 8,544,771 | B2 | 10/2013 | Ganser | 239/584 |
| 8,973,893 | B2 | 3/2015 | Lehner et al. | 251/129.06 |
| 2007/0221745 | A1 | 9/2007 | Stoecklein et al. | 239/88 |
| 2009/0065614 | A1 * | 3/2009 | Ganser | F02M 47/025 239/584 |

FOREIGN PATENT DOCUMENTS

| | | | | |
|---|---|---|---|---|
| DE | 19605277 | A1 | 8/1996 | F02M 47/02 |
| DE | 19958872 | A1 | 6/2000 | F02M 47/00 |
| DE | 10055714 | A1 | 6/2001 | F02M 47/00 |
| DE | 102004017303 | A1 | 10/2005 | F02M 47/02 |
| DE | 102008043690 | A1 | 5/2009 | F02M 47/02 |
| DE | 102008032133 | A1 | 1/2010 | F02M 51/06 |
| DE | 102009002554 | A1 | 1/2010 | F02M 47/02 |
| DE | 102010037715 | A1 | 6/2011 | F02M 47/02 |
| DE | 102010021169 | A1 | 11/2011 | F02D 41/00 |
| EP | 1533517 | A2 | 5/2005 | F02M 47/02 |
| WO | 2014/075988 | A1 | 5/2014 | F02M 47/02 |

OTHER PUBLICATIONS

International Search Report and Written Opinion, Application No. PCT/EP2013/073297, 19 pages, dated Feb. 27, 2014.

* cited by examiner

INJECTOR

CROSS-REFERENCE TO RELATED APPLICATIONS

This application is a U.S. National Stage Application of International Application No. PCT/EP2013/073297 filed Nov. 7, 2013, which designates the United States of America, and claims priority to DE Application No. 10 2012 220 610.8 filed Nov. 13, 2012, the contents of which are hereby incorporated by reference in their entirety.

TECHNICAL FIELD

The present disclosure relates generally to internal combustion engines and, more specifically, offers teachings that may be used in an injector having an injector housing, an actuator and a nozzle needle.

BACKGROUND

Injectors for injecting fuel into a combustion space of a combustion chamber may comprise an injector housing, a piezo-actuator, and a nozzle needle. The piezo-actuator is arranged in an actuator space of the injector housing. The injector housing comprises a control piston bore in which a control piston is arranged. A leakage pin bore is provided between the actuator space and the control piston bore, in which leakage pin bore a leakage pin, which couples the control piston to the piezo-actuator, is arranged. Furthermore, a high pressure line is provided which is configured to convey a fuel under pressure to the nozzle needle. This injector requires precisely adjusted fitting tolerance between the leakage pin bore and the leakage pin in the region of the leakage pin bore, which fitting tolerance is costly to manufacture. In addition, this fit also has to be adapted to a fitting tolerance between the control piston and the control piston bore so that the function for activating the nozzle needle is ensured.

SUMMARY

The teachings of the present disclosure may provide an improved injector, wherein the actuator is arranged in an actuator space of the injector housing, wherein the injector housing (15) comprises a control piston bore (60) in which a control piston (65) is arranged, wherein a leakage pin bore (105) is provided between the actuator space (45) and the control piston bore (60), in which leakage pin bore (105) a leakage pin (110), which couples the control piston (65) to the actuator (50), is arranged, wherein the control piston (65) is hydraulically operatively connected in order to open or close an outlet opening (166) of the injector housing (15) by means of the nozzle needle (155), wherein a high pressure line (25) is provided which is configured to convey a fuel under pressure to the nozzle needle.

In some embodiments, an injector (10; 230; 240; 265) may have an injector housing (15), an actuator (50) and a nozzle needle (155). The actuator (50) is arranged in an actuator space (45) of the injector housing (15). The injector housing (15) comprises a control piston bore (60) in which a control piston (65) is arranged. A leakage pin bore (105) is provided between the actuator space (45) and the control piston bore (60), in which leakage pin bore (105) a leakage pin (110), which couples the control piston (65) to the actuator (50), is arranged. The control piston (65) is hydraulically operatively connected in order to open or close an outlet opening (166) of the injector housing (15) by means of the nozzle needle (155). A high pressure line (25) is provided which is configured to convey a fuel under pressure to the nozzle needle (155). A feedline (225; 260) is provided in the injector housing (15) and connects the leakage pin bore (105) to the high pressure line (25).

In some embodiments, the control piston (65) forms, together with the control piston bore (60), a first control space (70) on a first end side (70) facing the leakage pin (110). A second control space (160) is provided on the end side of the nozzle needle (155). The first control space (75) is connected to the second control space (160) via a connection bore (165) in order to control a stroke movement of the nozzle needle (155).

In some embodiments, a nozzle needle sleeve (150) is provided, wherein the nozzle needle sleeve (150) and the nozzle needle (155) form first guide play (205), by means of which a first fuel leakage flow ($K_1$) is able to pass through to the second control space (160).

In some embodiments, the control piston (65) and the control piston bore (60) form piston play (210), by means of which a second fuel leakage flow ($K_2$) is able to pass through into the first control space (75), wherein second guide play (121), by means of which a third fuel leakage flow ($K_2$) is able to pass through into the actuator space, is provided between the leakage pin (110) and the leakage pin bore (105).

In some embodiments, an intermediate plate (125), in which the feedline (225; 260) and the leakage pin bore (105) are arranged, is provided between the actuator space (45) and the control piston bore (60).

In some embodiments, the intermediate plate (125) comprises at least a first and a second intermediate plate part (245, 250), wherein the feedline (225; 260) is arranged in a groove shape in at least the first intermediate plate part (245) and is closed off by the second intermediate plate part (250).

In some embodiments, the feedline (225; 260) is arranged essentially perpendicularly with respect to the high pressure line (25) and/or the leakage pin bore (105).

In some embodiments, the feedline (225; 260) is arranged essentially obliquely with respect to the high pressure line (25) and/or the leakage pin bore (105), wherein the feedline (225; 260) opens into an upper or lower region of the high pressure line (25).

In some embodiments, a restrictor (235, 265) is provided in the feedline (225; 260).

In some embodiments, the restrictor (235, 265) is arranged adjacent to the leakage pin bore (105) in the feedline (225; 260).

In some embodiments, the restrictor has a first cross-sectional area, and the leakage pin (110) and the leakage pin bore (105) form a second cross-sectional area in a plane transversely with respect to a longitudinal axis (20) of the injector (10; 230; 240; 265), wherein the first cross-sectional area is of the same size as the second cross-sectional area.

In some embodiments, the actuator (50) is embodied as a piezo-actuator (50).

BRIEF DESCRIPTION OF THE DRAWINGS

The properties, features and advantages of the teachings herein will become clearer and more clearly understood in conjunction with the following description of exemplary embodiments which are explained in more detail in conjunction with the drawings, wherein identical components are denoted by the same reference symbols.

In the drawings.

DETAILED DESCRIPTION

Figure 1:
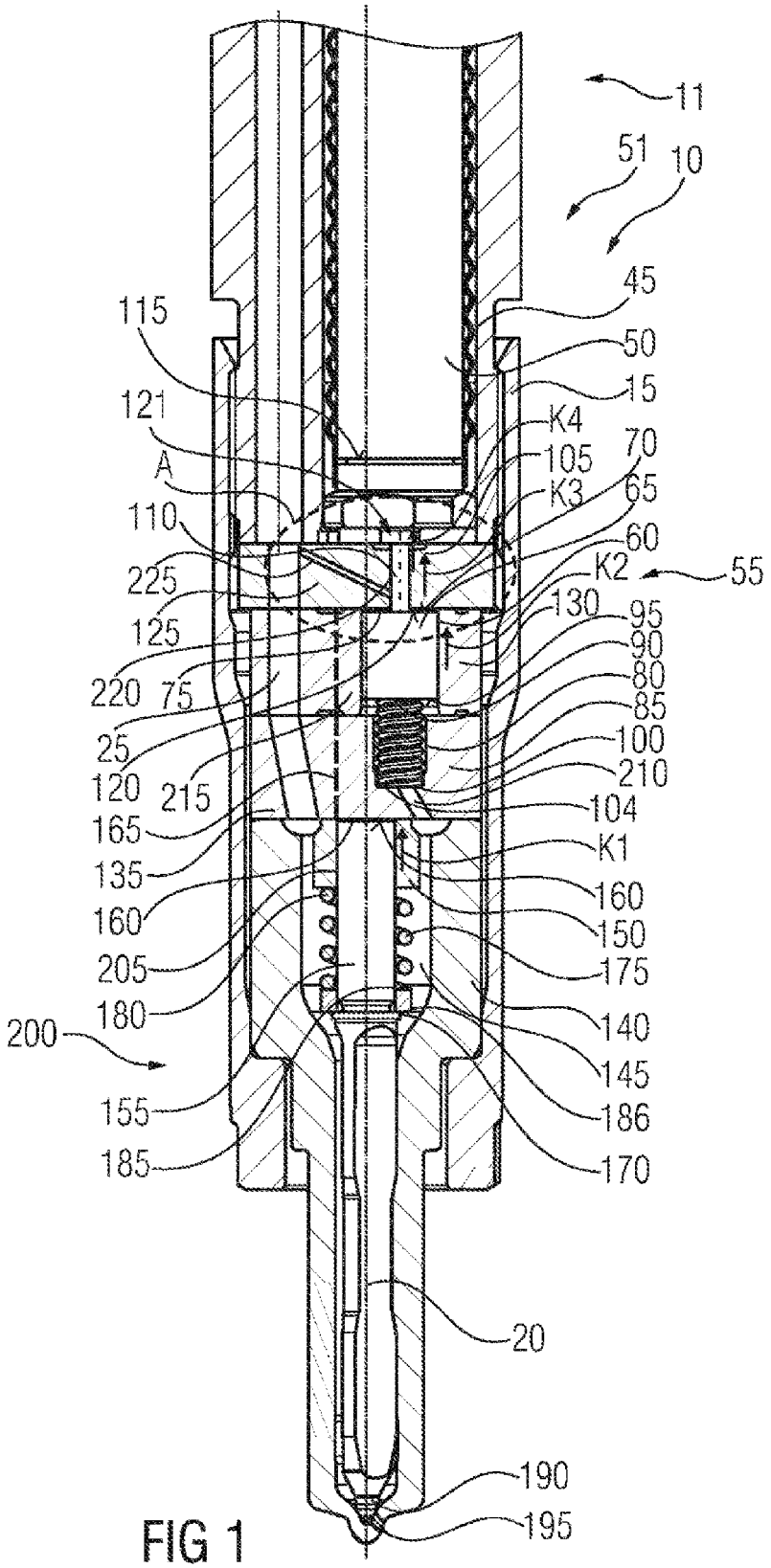
FIG. 1 shows a longitudinal section through a lower part of an injector according to a first embodiment.

In some embodiments, an actuator is arranged in an actuator space of the injector housing. The injector housing comprises a control piston bore in which a control piston is arranged, wherein a leakage pin bore is provided between the actuator space and the control piston bore, in which leakage pin bore a leakage pin, which couples the control piston to the actuator, is arranged. The control piston is hydraulically operatively connected in order to open or close an outlet opening of the injector housing with the nozzle needle. In addition, a high pressure line is provided which is configured to convey a fuel under pressure to the nozzle needle. Furthermore, a feedline is provided in the injector housing and connects the leakage pin bore to the high pressure line.

These embodiments have the advantage that the settings of the fitting tolerances between the leakage pin and the leakage pin bore as well as of the control piston with respect to the control piston bore are functionally disconnected from one another and no longer have to be matched to one another as a function of one another. As a result, the fabrication of the injector can be simplified. In addition, relatively tight fitting tolerance spaces can be selected for the leakage pin, for the leakage pin bore and for the control piston and the control piston bore, with the result that the rigidity of the injector is increased and therefore dead time of the injector is reduced. Furthermore, greater robustness over the service life of the injector is made possible, since a worn leakage pin or a worn leakage pin bore essentially has no further effects on the operating behavior of the injector. As a result of the possibility of selecting tight fitting tolerances of the leakage pin with respect to the leakage pin bore and of the control piston with respect to the control piston bore, low leakage or a low flow of fuel occurs via these fitting tolerances between the leakage pin and the leakage pin bore and the control piston and the control piston bore, with the result that a significantly smaller number of particles are passed through between the control piston and the control piston bore or the leakage pin and the leakage pin bore, and the wear between the leakage pin and the leakage pin bore or the control piston and the control piston bore is therefore also additionally reduced.

In some embodiments, the control piston forms, together with the control piston bore, a first control space on a first end side facing the leakage pin, wherein a second control space is provided on the end side of the nozzle needle, wherein the first control space is connected to the second control space via a connection bore in order to control a stroke movement of the nozzle needle.

A first control space can be delimited when a nozzle needle sleeve is provided, wherein the nozzle needle sleeve and the nozzle needle form first guide play, by means of which a first fuel leakage flow is able to pass through to the second control space.

In some embodiments, the control piston and the control piston bore form piston play, by means of which a second fuel leakage flow is able to pass through into the first control space, wherein second guide play, by means of which a third fuel leakage flow is able to pass through into the actuator space, is provided between the leakage pin and the leakage pin bore.

In some embodiments, an intermediate plate, in which the feedline and the leakage pin bore are arranged, is provided between the actuator space and the control piston bore.

In some embodiments, the intermediate plate comprises at least a first and a second intermediate plate part, wherein the feedline is arranged in a groove shape in at least the first intermediate plate part and is closed off by the second intermediate plate part. In this way, the feedline can easily be introduced into the intermediate plate or into the injector by means of a milling method, for example.

A relatively short working time for manufacturing the feedlines is required if the feedline is arranged essentially perpendicularly with respect to the high pressure line and/or the leakage pin bore.

In some embodiments, the feedline is arranged essentially obliquely with respect to the high pressure line and/or the leakage pin bore, wherein the feedline opens into an upper or lower region of the high pressure line. In this way, the feedline can easily be introduced into the intermediate plate by means of a drilling process, for example.

In some embodiments, a restrictor is provided in the feedline. In this way, the cross-sectional area for the passage of fuel can easily be determined as defined in the feedline.

In some embodiments, the restrictor is arranged adjacent to the leakage pin bore in the feedline.

In some embodiments, an improved operating behavior and a low leakage and therefore a energy-efficient injector may result if the restrictor has a first cross-sectional area, and the leakage pin and the leakage pin bore form a second cross-sectional area in a plane transversely with respect to a longitudinal axis of the injector, wherein the first cross-sectional area is of the same size as the second cross-sectional area.

In some embodiments, the actuator is embodied as a piezo-actuator. In this way, a particularly fast reaction time and a high activation pressure for activating the leakage pin can be made available.

Figure 2:
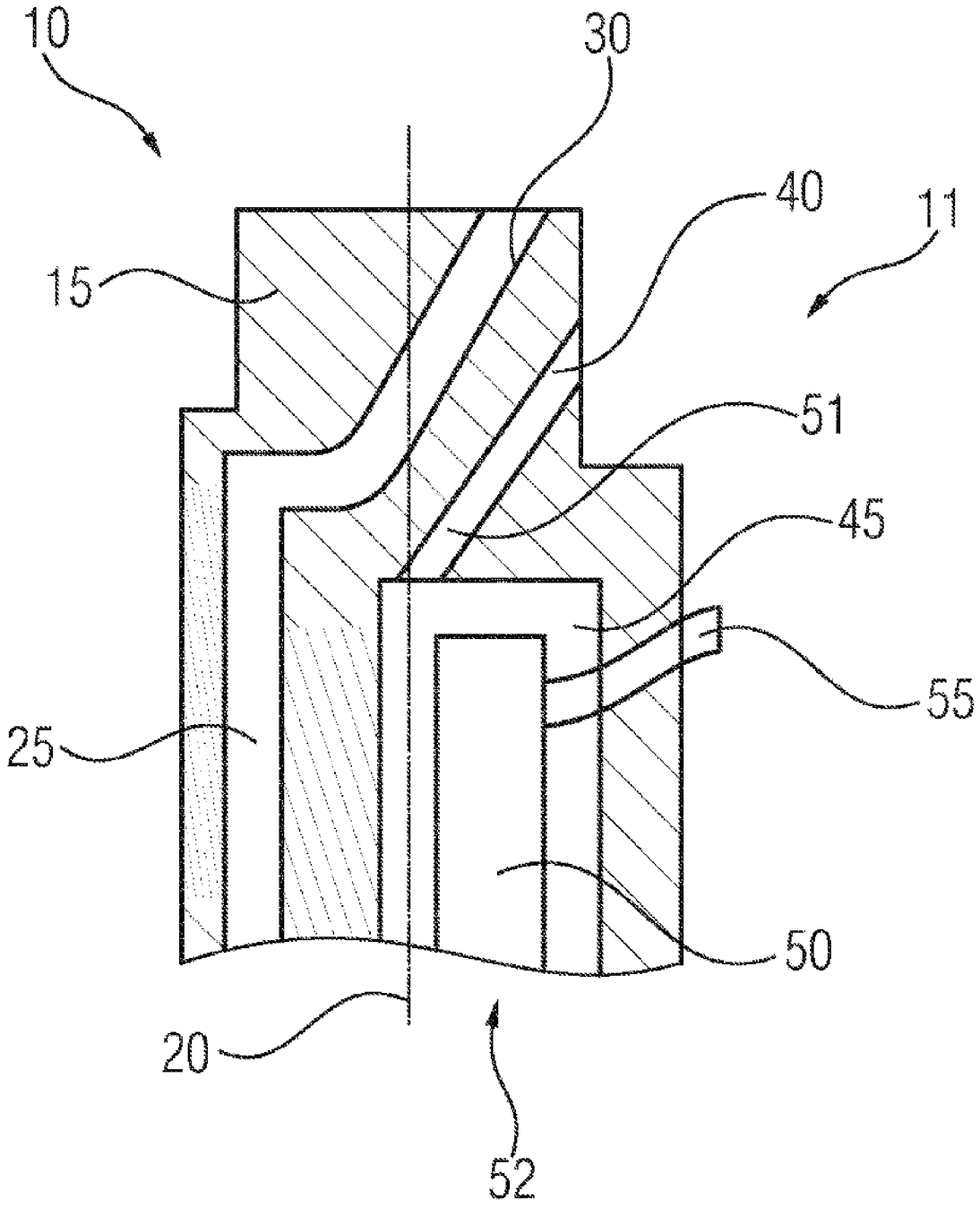
FIG. 2 shows a longitudinal section through an upper part of the injector shown in FIG. 1.
Figure 3:
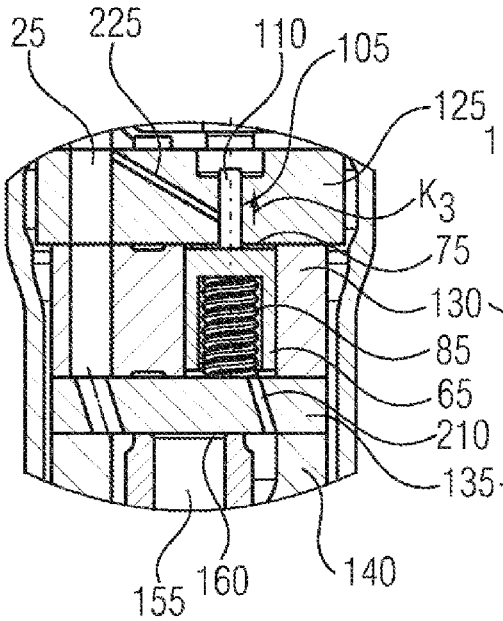
FIG. 3 shows a detail of the injector shown in FIGS. 1 and 2.

FIG. 1 shows a longitudinal section through a lower part of an example injector 10 according to a some embodiments. FIG. 2 shows a longitudinal section through an upper region 11 of the injector 10 shown in FIG. 1, and FIG. 3 shows a detail A of the injector 10 shown in FIGS. 1 and 2, where the detail A in FIG. 1 is marked by means of a dashed line. In the text which follows, the FIGS. 1 to 3 will be explained together.

The injector 10 can inject fuel, e.g., a diesel fuel, into an internal combustion engine which comprises a common rail injection system. The injector 10 has an injector housing 15. The injector housing 15 comprises a high pressure line 25 which extends parallel to a longitudinal axis 20 and to which fuel under high pressure can be fed via a high pressure terminal 30. The high pressure terminal 30 is arranged in an upper region 11. In addition, a leakage port 40 for returning fuel into a fuel tank of the motor vehicle is provided in the upper region 11 of the injector housing 15.

Furthermore, the injector housing 15 has, in the upper region 11 of the injector 10, an actuator space 45 in which a piezo-actuator 50 is arranged. As an alternative to the piezo-actuator 50, an actuator which is embodied in a magneto-restrictive fashion could also be arranged in the actuator space 45. The actuator space 45 also has a leakage connection 51 to the leakage port 40 and is therefore part of a low pressure region 52 of the injector 10. The piezo-actuator 50 may include a fully active piezo-stack with approximately a cylindrical shape and is supplied with an electrical voltage via an electrical terminal 54, in order to change a length of the piezo-actuator 50 in the longitudinal direction, that is to say in the direction of the longitudinal axis 20. In a lower region 55 of the injector housing 15, arranged underneath the upper region 11 in FIG. 1, the injector 10 has a control piston bore 60 in which a control piston 65 is arranged.

The control piston 65 has a first end side 70 which faces the piezo-actuator 50. The first end side 70 forms, together with the control piston bore 60, a first control space 75. Opposite the first end side 70, the control piston 65 forms, with a second end side 76, a spring space 80 in the control piston bore 60. The control piston 65 is arranged here between the first control space 75 and the spring space 80, so as to be moveable in the direction of the longitudinal axis 20.

In the spring space 80, a control piston spring 85 is provided which is embodied, for example, as a helical compression spring. In this context, a first longitudinal end 90 of the control piston spring 85 faces the second end side 76 of the control piston 65 and is supported thereon. A second longitudinal end 100 of the control piston spring 85 is supported on a lower end face 104, facing the second end side 90 of the control piston 65, of the control piston bore 60. The control piston spring 85 applies to the control piston 65 a force which acts in the direction of the first control space 75, parallel to the longitudinal axis 20.

It is to be noted that although the control piston 65, which is shown in FIGS. 1 and 2, is embodied in a different way, it is functionally identical. However, the configuration of the control piston 65 which is shown in FIGS. 3 to 6, wherein the piston space 80 is embodied as a bore in the control piston 65 for receiving the control piston spring 85, said configuration provides that the spring 85 can be accommodated completely in the control plate 130.

In some embodiments, a leakage pin bore 105 is arranged between the actuator space 45 and the first control space 75 of the control piston bore 60. In addition, a leakage pin 110 is arranged in the leakage pin bore 105, said leakage pin 110 bearing, on a third end side 115, on the piezo-actuator 50 and, with a fourth end side 120 of the leakage pin 110, on the first end side 70 of the control piston 65. The length of the leakage pin 110 or of the leakage pin bore 105 is selected in such a way that when the length of the piezo-actuator 50 is increased in the direction of the longitudinal axis 20, the change in length of the piezo-actuator 50 is transmitted to the control piston 65 via the leakage pin 110. The leakage pin 110 also has first bearing play 121, e.g., a clearance fit, in order to permit an axial movement of the leakage pin 110 in the leakage pin bore 105.

In some embodiments, the leakage pin bore 105 is arranged in an intermediate plate 125. The intermediate plate 125 bears on the top of a control plate 130 in which the control piston bore 60 is arranged. Underneath the control plate 130, a connecting plate 135 bears on said control plate 130. The high pressure line 25 extends through the connecting plate 135, the control plate 130 and the intermediate plate 125. A nozzle needle housing 140, in which the high pressure line 25 ends, bears on the connecting plate 135, underneath said connecting plate 135.

In some embodiments, a nozzle needle bore 145, which runs along the longitudinal axis 20 and is arranged in the one nozzle needle sleeve 150, is provided in the nozzle needle housing 140. In this context, the spring space 80 is connected to the nozzle needle bore 145 via a spring space bore 146. The nozzle needle sleeve 150 engages around the circumference of a nozzle needle 155. The nozzle needle 155 has on the upper side an upper end face 160 which faces the connecting plate 135. The upper end face 160 forms, together with the connecting plate 135 in the longitudinal direction 20 and together with the nozzle needle sleeve 150 in the radial direction with respect to the longitudinal axis 20, a second control space 160. The second control space 160 is connected to the first control space 75 via a schematically illustrated first connecting bore 165.

Underneath the nozzle needle sleeve 150, a collar 170 is provided on the nozzle needle 155, said collar 170 essentially perpendicular with respect to the longitudinal axis 20, running around the nozzle needle 155. A nozzle spring 175, e.g., a helical compression spring, is arranged between the collar 170 and the nozzle needle sleeve 150. In this context, a first longitudinal end 180 of the nozzle spring 175 is supported on the nozzle needle sleeve 150, and a second longitudinal end 185, arranged opposite the longitudinal end 180, of the nozzle spring 175 is supported on the collar 170 via a ring 186. The nozzle spring 175 applies to the nozzle needle 155 a force which acts on the parallel to the longitudinal axis 20 and away from the second control space 160. The nozzle needle 155 also has a nozzle tip 190 on a longitudinal side facing away from the upper end face 160. In addition, an outlet opening 195, which is closed off by the nozzle needle tip 190, is provided in the region of the nozzle tip 190.

The high pressure line 25 can be filled with a fuel which is under high pressure (1000 to 3000 bar), for example from a rail of a common rail injection system, and is therefore part of a high pressure region 200 of the injector 10. The fuel is fed to the nozzle needle bore 145 via the high pressure line 25. The nozzle needle sleeve 150 and the nozzle needle 155 have second guide play 205. As a result of the second guide play 205, the fuel under pressure is forced out of the nozzle needle bore 145 into the second control space 160 with a first fuel leakage flow $K_1$. The first fuel leakage flow $K_1$ is passed onto the first control space 75 via the first connecting bore 165.

The spring space 80 is connected to the nozzle needle bore 145 via a second connecting bore 210, with the result that the fuel is under high pressure in the spring space 80 and presses against the second end side 76 of the control piston 65. The control piston 65 has piston play 215 around an axial movement of the control piston 65 in the control piston bore 60, as a result of which piston play 215 a second fuel leakage flow $K_2$ flows in the direction of the first control space 75, in which the second fuel leakage flow $K_2$ combines with the first fuel leakage flow $K_1$. In the process, the fuel leakage flows occur only when the pressure in the first control space 75 is lower than the pressure in the high pressure line 25.

If the leakage pin 110 is pushed downward in the direction of the nozzle needle 155 by an increase in length of the piezo-actuator 50, said leakage pin 110 activates the control piston 65 and likewise presses the control piston 65 in the direction of the nozzle needle 155. As a result, the volume of the first control space 75 is increased, as a result of which the pressure is reduced, wherein, in order to equalize the pressure, fuel flows on from the second control space 160 via the first connecting bore 165 and therefore the pressure present in the second control space 160 drops. In addition, the first and the second fuel leakage flow $K_1$, $K_2$ also flow into the first control space 75. As a result of the drop in pressure in the second control space 160, a force for pressing the nozzle needle 155 against the outlet opening 166 decreases, with the result that the nozzle needle 155 is lifted up on the underside in the region of the nozzle needle tip 190 by the pressure present in the nozzle needle bore 145, and the nozzle needle spring 175 is compressed. As a result of the lifting up, fuel flows into a combustion space of an internal combustion engine from the nozzle needle bore 145 via the outlet opening 195.

In order to disable the outlet opening 195 or to disable the flowing out of fuel through the outlet opening 195, the piezo-actuator 50 is electrically actuated in such a way that it shortens again into its original state. The control piston spring 85 presses the control piston 65 in the direction of the actuator space 45, wherein the leakage pin 110 is likewise pressed in the direction of the actuator space 45. The leakage pin 110 follows the axial shortening of the piezo-actuator 50 here. In this context, the volume of the first control space 75 is reduced and the fuel located therein is forced into the second control space 160 via the first connecting bore 165. In addition, a portion of the fuel flows off into the actuator space 45 via a third fuel leakage flow $K_3$. The rise in pressure causes the pressure, as a result of the fuel located in the second control space 160 and the force of the nozzle needle spring 175, to be higher than that resulting from the fuel under pressure in the nozzle needle bore 145 for lifting off the nozzle needle 155, with the result that the nozzle needle 155 is forced downward again, with the result that the nozzle needle tip 190 closes the outlet opening 166 in the injector housing 15.

Figure 4:
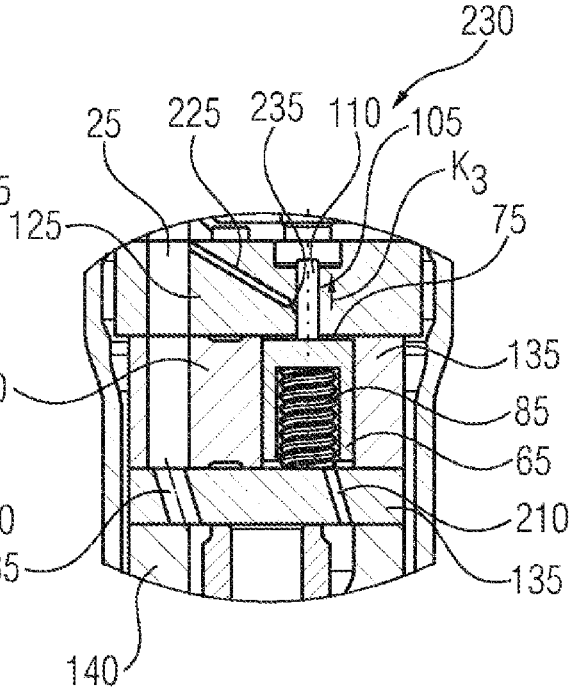
FIG. 4 shows a detail of an injector according to a second embodiment.

In addition, a feedline 225 is provided between the leakage pin bore 105 and the high pressure line 75 in the intermediate plate 125. In FIGS. 3 and 4, the feedline 225 is arranged obliquely with respect to the longitudinal axis 20 or with respect to the leakage pin 110 and ends in an upper region of the high pressure line 25. Of course, the feedline 225 can also be arranged transversely with respect to the longitudinal axis 20 or end in a lower region of the high pressure line 25. The oblique arrangement of the feedline 225 has the advantage that the feedline 225 can be introduced by means of an obliquely positioned drill through the leakage pin bore 105, which is already formed in the intermediate plate 125, or the high pressure line 25, in order to connect the high pressure line 25 to the leakage pin bore 105.

The high pressure line 25 supplies the feedline 225 with fuel under high pressure. This fuel places fuel located in the first guide play 121 under the pressure of the high pressure line 25. This causes the pressure difference at the leakage pin 110 between the high pressure region 200 and the low pressure region 52 of the injector 10 to be eliminated. This results in the low pressure region 52 becoming functionally disconnected from the function of the high pressure region 200.

In the case of a closed injector 10, rail pressure is present at a combination of the leakage pin bore 105 with the feedline 225, as in the first control space 75, with the result that an inflow of fuel, referred to as a fuel leakage flow $K_3$, into the first control space 75 via the feedline 225 is equal to zero. The entire quantity of fuel which flows in the feedline 225 in this state, flows off in the gap between the leakage pin bore 105 and the leakage pin 110 as a fuel leakage flow $K_4$ into the low pressure region 52. Since the leakage flow balance condition that the inflowing fuel leakage flow is equal to the outflowing fuel leakage flow has to be met for the first and second control spaces 75, 160, this means that the sum of fuel leakage flow $K_1$ and fuel leakage flow $K_2$ must also be equal to zero. As a result it is possible for the second guide play 205 and the piston play 215 to be configured for minimum guide play, with the result that clamping during operation of the injector 10 is avoided. Likewise, a requirement for minimum guide play in the piston play 215 or the second guide play 205 for ensuring minimum leakage flows can be avoided.

In the case of an open injector 10, a pressure which is lower than the rail pressure is present in the first and second control spaces 75, 160. This pressure gradient leads to a situation in which all three fuel leakage flows $K_1$, $K_2$ and $K_3$ enter the first and second control spaces 75, 160. As a result of the provision of the feedline 225, the first and second guide play 121 and 205 as well as the piston play 215 can also be configured for minimum possible play for this state of the injector 10, in order to prevent clamping. In addition, it is possible to avoid a situation in which the first and second guide play 121 and 205 as well as the piston play 215 have to be adapted to a minimum leakage flow in terms of in each case a as a result of the first or second guide play 121 and 205 or piston play 215. As a result, the configuration of the injector 10 can be simplified.

FIG. 4 shows a detail A of the injector shown in FIG. 1. The example injector 230 is embodied in an essentially identical fashion to the injector shown in FIG. 3. However, a restrictor 235 is additionally provided in the feedline 225 and is arranged adjacent to the leakage pin bore 110. The restrictor may be arranged at a distance of up to 20 percent of the length of the feedline from the leakage pin bore 105. The restrictor 235 has here a first cross-sectional area. The first guide play 121 is selected as a tolerance fit in order to ensure movement of the leakage pin 110. As a result there is a gap between the leakage pin 110 and the leakage pin bore 105. In a plane perpendicular to the longitudinal axis 20, the gap forms an annular face with a second cross-sectional area.

The first cross-sectional area is approximately of the same size as the second cross-sectional area here. In this way, the fuel leakage flow $K_3$ via the first guide play 121 can be particularly easily minimized, since only the fuel leakage flow $K_3$, which flows off into the actuator space 45, is equalized by the feedline 225, with the result that the injector has a particularly high level of efficiency, in particular in the dynamic mode. Since the pressure in the first control space corresponds to the pressure in the nozzle needle bore 145 as a result of the feedline 225, flowing off of fuel from the first control space in the direction of the nozzle needle bore 145 through leakage is also avoided.

In addition, the functional robustness of the injector with respect to possible wear on the leakage pin 110 is minimized by virtue of the fact that the first guide play 121 can be adapted in an optimum way to the loads on the leakage pin 110 in the leakage pin bore 105. In particular, the first guide play 121 can be selected in such a way that during the up and down movement the fuel located in the second guide play 121 for the purpose of lubrication does not move away, and therefore the direct rubbing of the leakage pin 110 against the leakage pin bore 105 can be avoided, and at the same time the third fuel leakage flow $K_3$ toward the actuator space 45 is minimized.

Figure 5:
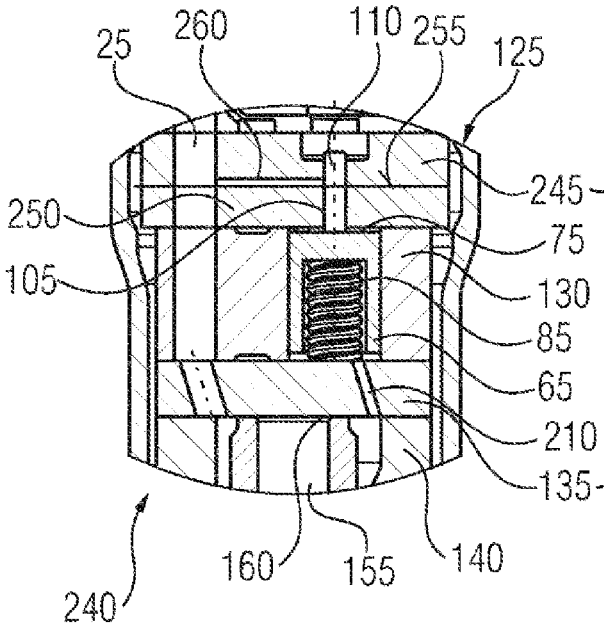
FIG. 5 shows a detail of an injector according to a third embodiment.

FIG. 5 shows a detail of an injector 240 shown in FIGS. 1 to 4. The example injector 240 is embodied here in an essentially identical fashion to the injector shown in FIGS. 1 to 4.

The intermediate plate 125 comprises, in addition to the embodiment shown in FIGS. 1 to 4, a first intermediate plate part 245 and a second intermediate plate part 250. In this context, the first intermediate plate part 245 is arranged adjacent to the actuator space 45, while the second intermediate plate part 250 bears on the control plate 130. In the first intermediate plate part 245, a feedline 260, which is embodied in a groove shape in the first intermediate plate part 245, is provided on the end side 255 facing the second intermediate plate part 250.

The feedline 260 extends radially outward from the leakage pin 110 to the high pressure line 25 here and connects the leakage pin bore 105 to the high pressure line 25. The groove-shaped configuration of the feedline 260 may be introduced in the first intermediate plate part 245, for example with a milling process. The feedline 260 is closed off on the underside by the second intermediate plate part 250, with the result that the two intermediate plate parts 245, 250 form a duct which connects the leakage pin bore 105 to the high pressure line 25. The feedline 260 can, depending on the desired configuration, have a rectangular, polygonal, round or trapezoidal cross section.

In the embodiment, the feedline 260 is arranged in the upper intermediate plate part 245. Of course, the feedline 260 can also be arranged in the lower second intermediate part 250 or in both intermediate plate parts 245, 250. Of course, the feedline 260 can also be composed of a plurality of feedline parts running one next to the other.

Figure 6:
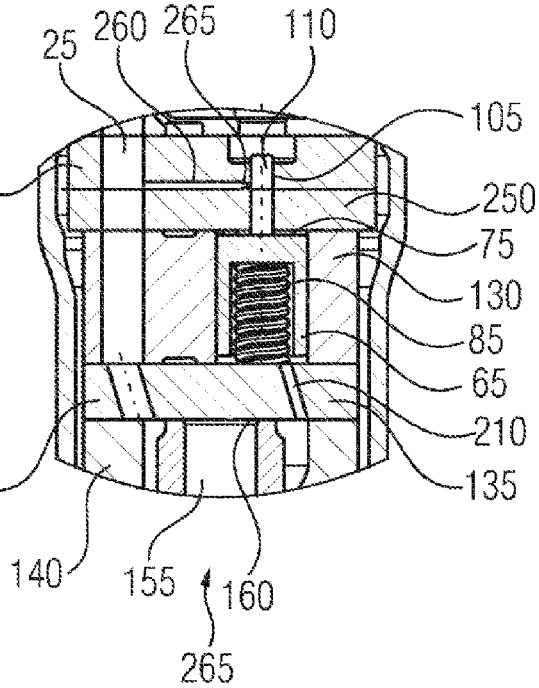
FIG. 6 shows a detail of an injector according to a fourth embodiment.

FIG. 6 shows a detail of the injector shown in FIG. 1. The example injector 265 is embodied in an essentially identical fashion to the injector shown in FIG. 5. In addition, a restrictor 265, which is arranged adjacent to the leakage pin bore 105, is provided in the feedline 260 here. The example restrictor 265 is embodied here, in terms of its dimensions, in a way which is similar to the restrictor explained in FIG. 4. Alternatively, the restrictor 265 can, as has also been explained above, be arranged at a distance from the leakage pin bore 105. In this way, the fuel leakage flow $K_3$ can be minimized particularly well in the dynamic mode of the injector 265. In addition, as has also been explained above, the wear of the leakage pin 110 in the leakage pin bore 105 can also be minimized.

The various embodiments of the injector 10, 230, 240, 265 may provide second guide play 205 and the piston play 215 can be selected independently of the first guide play 121 between the leakage pin 110 and the leakage pin bore 105. As a result, the guide plays 121, 205 as well as the piston play 215 can each be adapted in an optimum way to the respective function of the component, for example of the control piston 65 or of the nozzle needle sleeve 150. In addition it is possible to reduce significantly the second guide play 205 and/or the piston play 215 compared to the injectors known in the prior art, with the result that the rigidity of the control piston 65 in the control piston bore 60 is increased and at the same time a dead time of the injector is reduced. In addition, the robustness of the injector 10, 230, 240, 265 is increased, with the result that the injector 10, 230, 240, 265 has a longer service life since the wear on the leakage pin 111 has virtually no effect on the behavior of the control piston 65 or of the actuation of the nozzle needle 155.

As a result of selecting smaller values for the guide plays 205, 121 and/or the reduced piston play 210, the leakage within the injector 10, 230, 240, 265 is reduced. This also results in particles, which have been introduced into the injector, for example, within the fuel despite a fuel filter, or particles arising from wear of the high pressure pump or of the injector 10, 230, 240, 265, being passed to a significantly smaller degree into the guide plays 205, 121 and/or into the piston play 210 and being able to cause further wear there.

Although illustrated and described in detail by means of various exemplary embodiments, the teachings herein are not restricted by the disclosed examples and other variations can be derived therefrom by a person skilled in the art without departing from the scope of the teachings of the present disclosure. It is therefore possible, for example, for the restrictor 235, 265 also to be arranged adjacent to the high pressure line 25. It is also conceivable for the first cross-sectional area of the restrictor 235, 265 to be nominally larger than the second cross-sectional area of the first guide play 121.

LIST OF REFERENCE SYMBOLS

10 Injector
11 Upper region
15 Injector housing
20 Longitudinal axis
25 High pressure line
30 High pressure port
40 Leakage port
45 Actuator space
50 Piezo-actuator
51 Leakage connection
52 Low pressure region
54 Electrical terminal
55 Lower region
60 Control piston bore
65 Control piston
70 First end side
75 First control space
76 Second end side
80 Spring space
85 Control piston spring
90 First longitudinal end
100 Second longitudinal end
104 Lower end side
105 Leakage pin bore
110 Leakage pin
115 Third end side
120 Fourth end side
121 First guide play
125 Intermediate plate
130 Control plate
135 Connecting plate
140 Nozzle needle housing
145 Nozzle needle bore
150 Nozzle needle sleeve
155 Nozzle needle
160 Second control space
165 First connecting bore
166 Outlet opening
170 Collar
175 Nozzle spring
180 First longitudinal end
185 Second longitudinal end
186 Ring
190 Nozzle needle tip
200 High pressure region
205 Second guide play

210 Second connecting bore
215 Piston play
225 Feedline
235 Restrictor
240 Injector
245 First intermediate plate part
250 Second intermediate plate part
255 End side
260 Feedline
265 Restrictor
$K_1$ First fuel leakage flow
$K_2$ Second fuel leakage flow
$K_3$ Third fuel leakage flow
$K_4$ Fourth fuel leakage flow

What is claimed is:

1. An injector having an injector housing, an actuator, and a nozzle needle, wherein the actuator is arranged in an actuator space of the injector housing, the injector comprising:

a control piston bore in the injector housing, in which a control piston is in sliding contact with side walls of the control piston bore, wherein the control piston comprises a circular first end side;

a leakage pin bore between the actuator space and the control piston bore;

a leakage pin coupling the control piston to the actuator, the leakage pin arranged in the leakage pin bore and in contact with the circular first end side of the control piston;

wherein the control piston and the control piston bore together define a first control space between the first end side and the side walls of the control piston bore and an end wall of the control piston bore;

the control piston bore in hydraulic communication with a second control space of the nozzle needle in order to open or close an outlet opening of the injector housing upon movement of the control piston, the second control space having a first side defined by an upper surface of the nozzle needle and an opposing second side defined by a lower surface of a connecting plate rigidly secured in a longitudinal direction in the injector housing, the lower surface of the connecting plate directly facing the upper surface of the nozzle needle;

a connection bore connecting the first control space to the second control space and allowing fluid flow from the second control space to the first control space;

a nozzle needle sleeve radially surrounding an upper end of the nozzle needle, wherein the nozzle needle sleeve and the nozzle needle define a first guide play, by means of which a first fuel leakage flow passes through to the second control space;

an upper end face on the upper surface of the nozzle needle facing the lower surface of the connecting plate;

the nozzle needle sleeve including a first lip for a nozzle needle spring forcing the nozzle needle away from the nozzle needle sleeve and the connecting plate;

the nozzle needle spring compressed between the first lip of the nozzle needle sleeve and a collar on the nozzle needle;

wherein movement of the control piston lowers pressure in the first control space, which causes fluid flow from the second control space to the first control space via the connection bore, which reduces the pressure in a second control space, thereby causing movement of thee nozzle needle away from the outlet opening against the force of the nozzle needle spring;

a high-pressure line configured to convey a fuel under pressure to the nozzle needle; and a feedline in the injector housing connecting the leakage pin bore to the high-pressure line.

2. The injector as claimed claim 1, wherein the control piston and the control piston bore define a piston play, by means of which a second fuel leakage flow passes through into the first control space; and a second guide play, by means of which a third fuel leakage flow is able to pass through into the actuator space, is defined between the leakage pin and the leakage pin bore.

3. The injector as claimed in claim 1, further comprising an intermediate plate in which the feedline and the leakage pin bore are arranged, is disposed between the actuator space and the control piston bore.

4. The injector as claimed in claim 3, wherein:

the intermediate plate comprises at least a first and a second intermediate plate part;

the feedline is arranged in a groove shape defined at least partially by the first intermediate plate part and is closed off by the second intermediate plate part.

5. The injector as claimed in claim 1, wherein the feedline is arranged essentially perpendicularly with respect to the high-pressure line and/or the leakage pin bore.

6. The injector as claimed in claim 1, wherein:

the feedline is arranged essentially obliquely with respect to the high pressure line and/or the leakage pin bore; and the feedline opens into an upper or lower region of the high pressure line.

7. The injector as claimed in claim 1, further comprising a restrictor provided in the feedline.

8. The injector as claimed in claim 7, wherein the restrictor is adjacent to the leakage pin bore in the feedline.

9. The injector as claimed in claim 7, wherein:

the restrictor has a first cross-sectional area;

the leakage pin and the leakage pin bore form a second cross-sectional area in a plane transversely with respect to a longitudinal axis of the injector; and the first cross-sectional area is of the same size as the second cross-sectional area.

10. The injector as claimed in claim 1 wherein the actuator comprises a piezo-actuator.

* * * * *